US009535384B2

(12) United States Patent
Osada

(10) Patent No.: US 9,535,384 B2
(45) Date of Patent: Jan. 3, 2017

(54) PRINTING APPARATUS, METHOD FOR CONTROLLING THE SAME, PROGRAM, AND STORAGE MEDIUM

(71) Applicant: CANON KABUSHIKI KAISHA, Tokyo (JP)

(72) Inventor: Tomoaki Osada, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/943,538

(22) Filed: Nov. 17, 2015

(65) Prior Publication Data

US 2016/0147186 A1 May 26, 2016

(30) Foreign Application Priority Data

Nov. 20, 2014 (WO) ..... PCT/JP2014/080760

(51) Int. Cl.
*G03G 15/00* (2006.01)

(52) U.S. Cl.
CPC .... *G03G 15/50* (2013.01); *G03G 2215/00569* (2013.01)

(58) Field of Classification Search
CPC ..... G03G 15/50; G03G 2215/00569
See application file for complete search history.

(56) References Cited

U.S. PATENT DOCUMENTS

2005/0084308 A1* 4/2005 Nakamura ..... G03G 15/50 399/407
2006/0269310 A1* 11/2006 German ..... G03G 15/50 399/82
2007/0024894 A1* 2/2007 Moore ..... G03G 15/50 358/1.15
2007/0071465 A1* 3/2007 Hamby ..... G03G 15/20 399/45
2010/0271649 A1* 10/2010 Suh ..... G03G 15/0178 358/1.13
2012/0201549 A1* 8/2012 Sakata ..... G03G 15/6591 399/16
2013/0057607 A1* 3/2013 Wakai ..... B41J 13/0009 347/9

FOREIGN PATENT DOCUMENTS

| | | | |
|---|---|---|---|
| JP | H11-194665 | A | 7/1999 |
| JP | 2007-072119 | A | 3/2007 |
| JP | 2007-226356 | A | 9/2007 |
| JP | 2008-054285 | A | 3/2008 |
| JP | 2008-173874 | A | 7/2008 |
| JP | 2008-269318 | A | 11/2008 |
| JP | 2010-155433 | A | 7/2010 |

* cited by examiner

*Primary Examiner* — Rodney Bonnette

(74) *Attorney, Agent, or Firm* — Canon USA, Inc. I.P. Division

(57) ABSTRACT

In a case where a sheet for sample printing is fed from a feeding deck after an instruction for executing the sample printing is received, a long period of time is required to discharge the sheet which has been subjected to the sample printing to a sample tray. Control is performed such that the sample printing is performed on a specific one of a plurality of sheets fed from sheet holding units for executing main printing, when an instruction for executing the sample printing is received from the user.

13 Claims, 12 Drawing Sheets

PRINTING APPARATUS, METHOD FOR CONTROLLING THE SAME, PROGRAM, AND STORAGE MEDIUM

TECHNICAL FIELD

The present invention relates to a printing apparatus which performs printing on a sheet, a method for controlling the printing apparatus, a program, and a storage medium.

BACKGROUND ART

Printing apparatuses which perform printing of a page being printed on a sheet which is different from a sheet for main printing (hereinafter referred to as "sample printing") so that a user checks quality (layout and colors, for example) of a printed matter have been used. Such a printing apparatus discharges a sheet which has been subjected to the sample printing to a discharge tray (a sample tray) which is different from a discharge tray (a stack tray) for the main printing (refer to PTL1).

CITATION LIST

Patent Literature

PTL 1 Japanese Patent Laid-Open No. 2008-54285

In the printing apparatus disclosed in PTL1, after an instruction for executing the sample printing is issued by a user, a sheet for the sample printing is fed from a feeding deck. Specifically, since the sheet for the sample printing is fed from the feeding deck after the instruction for executing the sample printing is received, a long period of time is required to discharge the sheet which has been subjected to the sample printing to the sample tray. In particular, in a case where a conveying path from the feeding deck to an image forming section is long, a long period of time is required for conveying the sheet fed from the feeding deck to the image forming section.

The present invention provides an apparatus and a method for checking a result of sample printing performed on a sheet by a user earlier than a case where a general apparatus and a general method are used.

SUMMARY OF INVENTION

To attain the object described above, a printing apparatus according to an embodiment of the present invention has a configuration described below.

Specifically, the printing apparatus includes a first printing unit configured to perform printing on a plurality of sheets on the basis of print data of a plurality of pages, a second printing unit configured to perform printing on a sheet on the basis of print data of a specific page selected from among the print data of the plurality of pages, a receiving unit configured to receive an instruction for executing the printing performed by the second printing unit from a user, and a print controlling unit configured to perform control such that the printing is performed by the second printing unit on a specific sheet selected from among the plurality of sheets fed from sheet holding units for the printing performed by the first printing unit, according to the receiving the instruction by the receiving unit.

Further features of the present invention will become apparent from the following description of exemplary embodiments with reference to the attached drawings.

DESCRIPTION OF EMBODIMENTS

Hereinafter, an embodiment of the present invention will be described in detail with reference to the accompanying drawings. Note that the embodiment herein does not limit the present invention associated with the range of the claims, and it is not necessarily the case that all combinations of features described in this embodiment are essential for means for solving problems of the present invention.

First Embodiment

Figure 1:
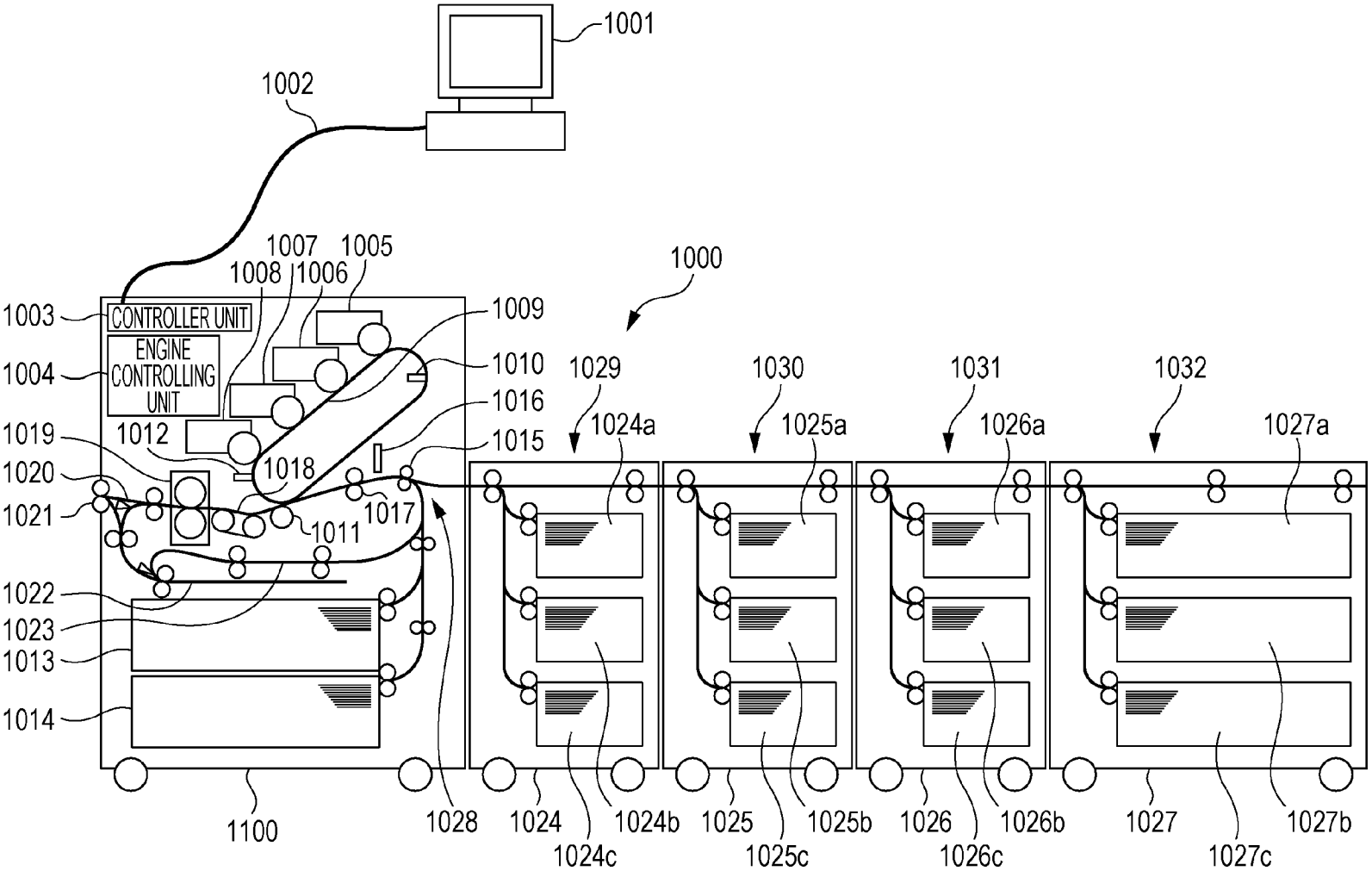
FIG. 1 is a sectional view illustrating a configuration of a digital printing system according to a first embodiment.

A configuration of a digital printing system according to a first embodiment of the present invention will be described with reference to FIG. 1.

In the first embodiment, a CPU 2100 performs control such that sample printing is executed on a specific sheet selected from among a plurality of sheets fed from sheet holding units for execution of main printing when receiving an instruction for executing the sample printing from a user. By this, the user may check a result of the sample printing performed on a sheet earlier than a case where a general apparatus and a general method are used.

Detailed description will be made hereinafter.

The digital printing system according to this embodiment includes a digital printer (printing apparatus) 1000 and a PC (computer) 1001 which is an example of an external apparatus.

Note that the printing apparatus 1000 includes an image reading function of reading a document so as to generate image data and a printing function (a copy function) of printing an image on a sheet on the basis of the generated image data. Furthermore, the printing apparatus 1000 has a printing function (a PC printing function) of receiving a print job from the PC 1001 or the like and printing a character and an image on a sheet on the basis of data which is instructed to be printed. Note that the printing performed by the printing function may be color printing or black-and-white printing.

A controller unit (control unit) 1003 of the printing apparatus 1000 is connected to the PC 1001 through a network cable 1002. Note that it is not necessarily the case that the controller unit 1003 and the PC 1001 are connected to each other through the network cable 1002. The controller unit 1003 and the PC 1001 may be connected to each other through a LAN, such as a local area network, a WAN, such as the Internet, or a dedicated printer cable. Note that LAN stands for "Local Area Network". WAN stands for "Wide Area Network". Although the configuration in which the single PC 1001 is connected to the printing apparatus 1000 through the network cable 1002 is illustrated in FIG. 1, the present invention is not limited to this. A plurality of PCs 1001 may be connected to the printing apparatus 1000 through network cables 1002.

The printing apparatus 1000 includes the controller unit 1003, an operation unit 160, a scanner unit 140, a document feeder 141, and a printer unit 120. These components are electrically connected to one another and perform transmission and reception of control commands and data among them.

The PC 1001 generates image data by application software, for example, and transmits the generated image data to the printing apparatus 1000. Furthermore, the PC 1001 generates page description language (PDL) data using application software or a printer driver, for example. The controller unit 1003 performs RIP development on the PDL data supplied from the PC 1001 through the network cable 1002 so as to obtain image data and a control command. Note that RIP stands for "Raster Image Processor". A program for executing an operation of performing the RIP development and the like are stored in a ROM 2120 or an HDD 2130 described later with reference to FIG. 2.

Although the PC 1001 is taken as an example of an external apparatus in this embodiment, the external apparatus is not limited to the PC 1001 and a mobile information terminal, such as a personal digital assistant (PDA) or a smartphone, a network connection device, an external dedicated apparatus, or the like may be used.

A print engine controlling unit 1004 controls a print engine 1100 included in the printing apparatus 1000. The print engine controlling unit 1004 drives the print engine 1100 in accordance with the control command and the image data developed by the controller unit 1003 so as to execute image forming.

Feeding decks 1024 to 1027 are consecutively connected to the print engine 1100. The feeding deck 1024 is connected to the print engine 1100 on an upstream side of a pre-registration roller 1015 of the print engine 1100. The feeding deck 1025 is connected to the feeding deck 1024 on an upstream side of the feeding deck 1024. The feeding deck 1026 is connected to the feeding deck 1025 on an upstream side of the feeding deck 1025. The feeding deck 1027 is connected to the feeding deck 1026 on an upstream side of the feeding deck 1026. Each of the feeding decks 1024 to 1027 includes three feeding trays (a, b, and c).

Each of image forming units 1005 to 1008 includes a photosensitive drum, a primary charger, a laser exposing device, a developing sleeve, and a drum cleaner. The image forming units 1005 to 1008 form an image of Y (yellow), an image of M (magenta), an image of C (cyan), and an image of K (black), respectively, and transfer the individual images to an intermediate transfer belt 1009.

The images formed by the image forming units 1005 to 1008 are transferred on the intermediate transfer belt 1009 in a superimposing manner so that a single color image is obtained. The image forming units 1005 to 1008 perform the transfer in synchronization with a timing of detection by a home position sensor 1010 of the intermediate transfer belt 1009. By this, an image in which the colors are not shifted is primarily transferred on the intermediate transfer belt 1009.

A secondary transfer roller 1011 transfers the image on the intermediate transfer belt 1009 to a sheet supplied from one of feeding cassettes 1013 and 1014 included in the print engine 1100 or one of the feeding trays (a, b, and c) included in the feeding decks 1024 to 1027.

A belt cleaner 1012 cleans the intermediate transfer belt 1009 after the secondary transfer.

A sheet fed from one of the feeding cassettes 1013 and 1014 or one of the feeding trays (a, b, and c) of the feeding decks 1024 to 1027 is conveyed by the pre-registration roller 1015. Then the sheet abuts on a registration roller 1017 in accordance with a signal detected by a registration sensor so that a registration loop is formed. Thereafter, the sheet is conveyed by the registration roller 1017 and the pre-registration roller 1015 in synchronization with transmission of the image on the intermediate transfer belt 1009 to a secondary transfer position, and the sheet and the image are supplied to the secondary transfer roller 1011 in a synchronization manner. In this way, secondary transfer is executed.

The sheet which has been subjected to the secondary transfer is conveyed to a fixing device 1019 by a post-secondary transfer conveying belt 1018. The fixing device 1019 performs a fixing process on the sheet which has been subjected to the secondary transfer.

In a case where the sheet subjected to the fixing process is set to be discharged outside the apparatus, a reversing flapper 1020 supplies the sheet subjected to the fixing process to a discharge roller 1021 so as to discharge the sheet subjected to the fixing process to the outside of the apparatus.

On the other hand, in a case where the sheet subjected to the fixing process is set to be discharged inside the apparatus, the reversing flapper 1020 supplies the sheet subjected to the fixing process to a reversing path 1022 so as to discharge the sheet subjected to the fixing process to the inside of the apparatus. Thereafter, the reversing path 1022 feeds the sheet when both-side printing is to be performed, and by drawing the sheet by switchback, the sheet is turned back. A both-side conveying path 1023 conveys the sheet again to the pre-registration roller 1015 so that printing is performed on a back surface of the sheet which is turned back by the reversing path 1022.

When a leading portion of the sheet fed from one of the feeding units reaches a preliminary feeding position 1028 in the print engine 1100 or a corresponding one of preliminary feeding positions 1029 to 1032 in the feeding decks 1024 to 1027, control is performed so that the conveyance of the sheet is temporarily stopped. In the consecutive connection among the feeding decks 1024 to 1027 and the print engine 1100, when a sheet does not exist in a certain one of the preliminary feeding positions located on a downstream side, a sheet existing in one of the preliminary feeding positions on an upstream side is conveyed to the preliminary feeding position on the downstream side.

Note that, in conveying paths included in the feeding decks 1024 to 1027 and conveying paths on an upstream side relative to the registration roller 1017, high-speed feeding is performed at a speed higher than a conveying speed (a process speed) of a sheet in a conveying path on a downstream side in which the secondary transfer and the fixing are performed. Accordingly, the sheet fed from one of the feeding decks 1024 to 1027 does not delay for a transfer timing.

Although the case where the print engine 1100 according to this embodiment is a color machine having four photosensitive drums and four image forming units 1005 is described, the present invention is not limited to this. Even in a case where the print engine 1100 is a black and white machine having a single photosensitive drum and a single image forming unit, the present invention may be similarly applied.

Furthermore, although the case where the method for printing an image on a sheet by an electronic photographing method is employed in the print engine 1100 according to this embodiment is described, the present invention is not limited to this. An inkjet method or other methods (a thermal transfer method and the like) may be employed as long as an image may be printed on a sheet.

Figure 2:
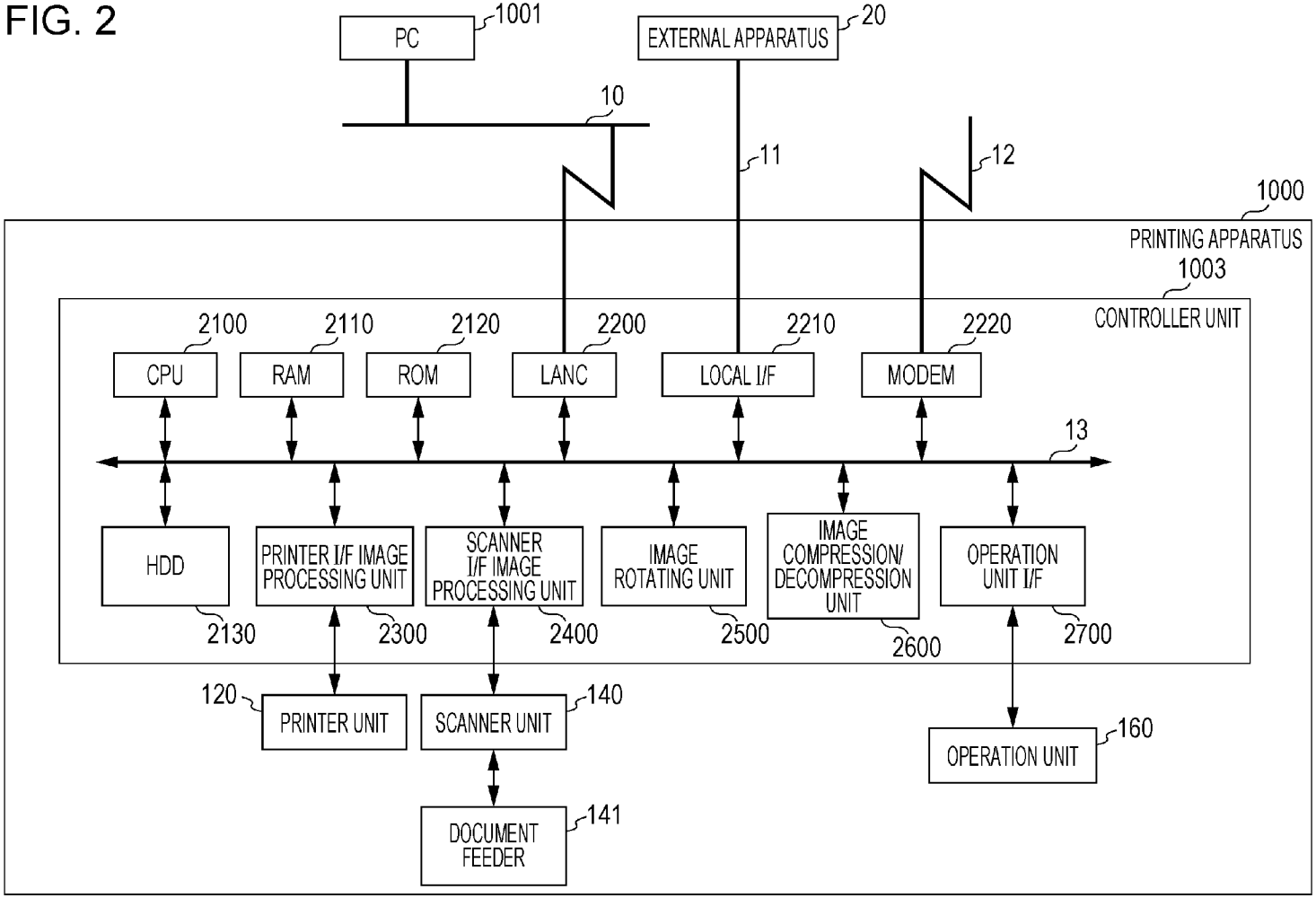
FIG. 2 is a block diagram illustrating a printing apparatus according to the first embodiment.

Next, a block diagram of the printing apparatus 1000 according to this embodiment is illustrated in FIG. 2.

The controller unit 1003 includes the CPU 2100, the RAM 2110, the ROM 2120, the HDD 2130, a LANC 2200, a local I/F 2210, and a MODEM 2220 as a plurality of functional blocks. The controller unit 1003 further includes a printer I/F image processing unit 2300, a scanner I/F image processing unit 2400, an image rotating unit 2500, an image compression/decompression unit 260, and an operation unit I/F 2700. These components are electrically connected to one another through a bus 13 and perform transmission and reception of control commands and data among them.

The controller unit 1003 is connected to the scanner unit 140 serving as an image input device, the printer unit 120 serving as an image output device, a LAN 10, a public line 12, and the like. The controller unit 1003 integrally controls the operation of the printing apparatus 1000, and in addition, performs control of input and output of image information and device information.

The CPU 2100 is a processor which controls the entire printing apparatus 1000. The CPU 2100 integrally controls accesses to various devices being connected in accordance with a control program and the like stored in the ROM 2120. Furthermore, the CPU 2100 integrally controls various processes performed in the controller unit 1003.

The RAM 2110 is a readable and writable memory. Furthermore, the RAM 2110 is a system work memory for operating the CPU 2100. In addition, the RAM 2110 stores image data, various programs, setting information, and the like input by the scanner unit 140, the PC 1001, and an external apparatus 20. The RAM 2110 is a dynamic random access memory (DRAM), for example.

The ROM 2120 is a read only memory. Furthermore, the ROM 2120 is a boot ROM and stores a boot program of the system in advance.

The HDD 2130 mainly stores information (system software) required for activating and operating the computer and image data. Although a case where the system software and the image data are stored in the HDD 2130 is described, the present invention is not limited to this. The system software and the image data may be stored in a storage medium (a nonvolatile memory) capable of maintaining storage even when power is turned off.

The ROM 2120 or the HDD 2130 stores various control programs required for executing various processes and the like in a flowchart described below therein. Furthermore, the ROM 2120 or the HDD 2130 stores a display control program for displaying various UI screens on a display unit 161 of the operation unit 160 described later with reference to FIG. 3 including a user interface screen (hereinafter referred to as a "UI screen"). The CPU 2100 reads a program stored in the ROM 2120 or the HDD 2130 and develops the program in the RAM 2110 so that various operations of this embodiment are executed.

Figure 3:
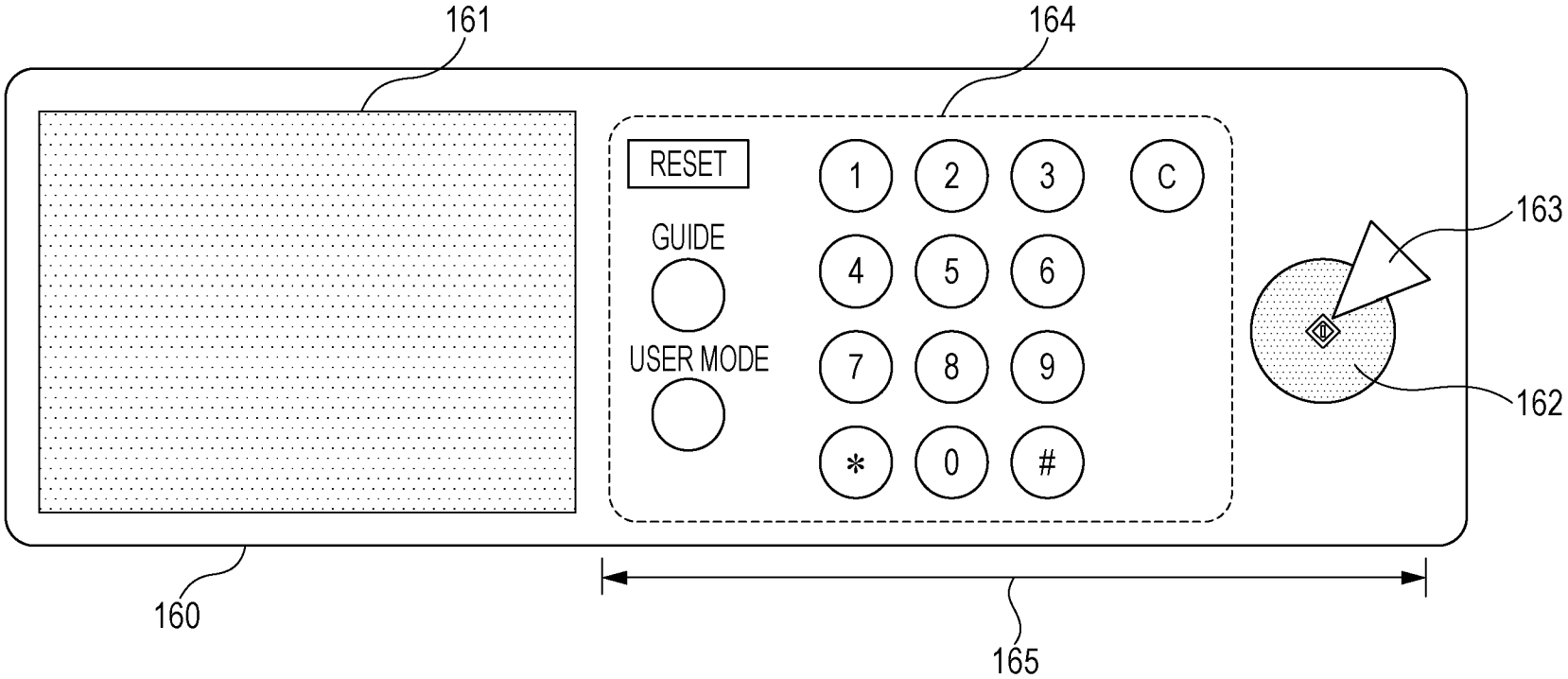
FIG. 3 is a top view of an operation unit of the printing apparatus according to the first embodiment.

The operation unit 160 is an example of a user interface unit. A top view of the operation unit 160 is illustrated in FIG. 3. As illustrated in FIG. 3, the operation unit 160 includes the display unit 161 and a key input unit 165 (a start key 162, a stop key 163, and a hard key group 164). Furthermore, the operation unit 160 has a function of accepting various settings performed by a user through the display unit 161 or the key input unit 165. Furthermore, the operation unit 160 has a function of providing the user with information through the display unit 161.

The display unit 161 is constituted by a liquid crystal display (LCD) and a touch panel sheet having transparent electrodes attached on the LCD (or an electrostatic method). An operation screen is displayed in the LCD, and in addition, a state of the printing apparatus 1000 is displayed in the LCD.

The start key 162 is used to instruct start of execution of scanning, copying, and the like. Furthermore, the stop key 163 is used to instruct stop of an operation being executed, such as scanning or copying. Moreover, the hard key group 164 includes a numeric keypad, a clear key, a resetting key, a guide key, and a user mode key.

The description is now continued with reference to FIG. 2 again.

The LANC (LANC controller) 2200 connected to the LAN 10 performs input and output of output image data between the LANC 2200 and the PC 1001 and input and output of information associated with device control.

The local I/F (local interface) 2210 is an interface, such as a universal serial bus (USB), and is connected to the external apparatus 20, such as a printer or a facsimile, through a cable 11 so as to perform input and output of data.

The MODEM 2220 connected to the public line 12 performs input and output of data.

The printer I/F image processing unit 2300 connected to the printer unit 120 performs communication with a CPU included in the printer unit 120. Furthermore, the printer I/F image processing unit 2300 performs conversion between a synchronous system and an asynchronous system of image data and an image process for print outputting.

The scanner I/F image processing unit 2400 connected to the scanner unit 140 including the document feeder 141 performs communication with a CPU included in the scanner unit 140. Furthermore, the scanner I/F image processing unit 2400 performs conversion between a synchronous system and an asynchronous system of image data and an image process for reading an image (such as a stripe detection process and a blank sheet detection process).

The image rotating unit 2500 performs a rotation process on input image data in accordance with a processing condition set by the user through the operation unit 160 or a direction of a document.

The image compression/decompression unit 2600 performs a process of compressing multi-value image data into JPEG data and compressing binary image data into JBIG data, MMR data, MH data, or the like. Furthermore, the image compression/decompression unit 2600 performs a process of decompressing compressed image data where appropriate.

The operation unit I/F 2700 outputs image data to be displayed in the operation unit 160 to the operation unit 160 from the controller unit 1003, and outputs information input by the user using the operation unit 160 to the controller unit 1003.

According to the first embodiment, the CPU 2100 performs control such that the sample printing is performed on a specific one of the plurality of sheets fed to execute the main printing from the sheet holding units, when receiving an instruction for executing the sample printing issued by the user. By this, the user may check a result of the sample printing performed on a sheet earlier than a case where a general apparatus and a general method are used.

Detailed description will be made hereinafter.

Figure 4:
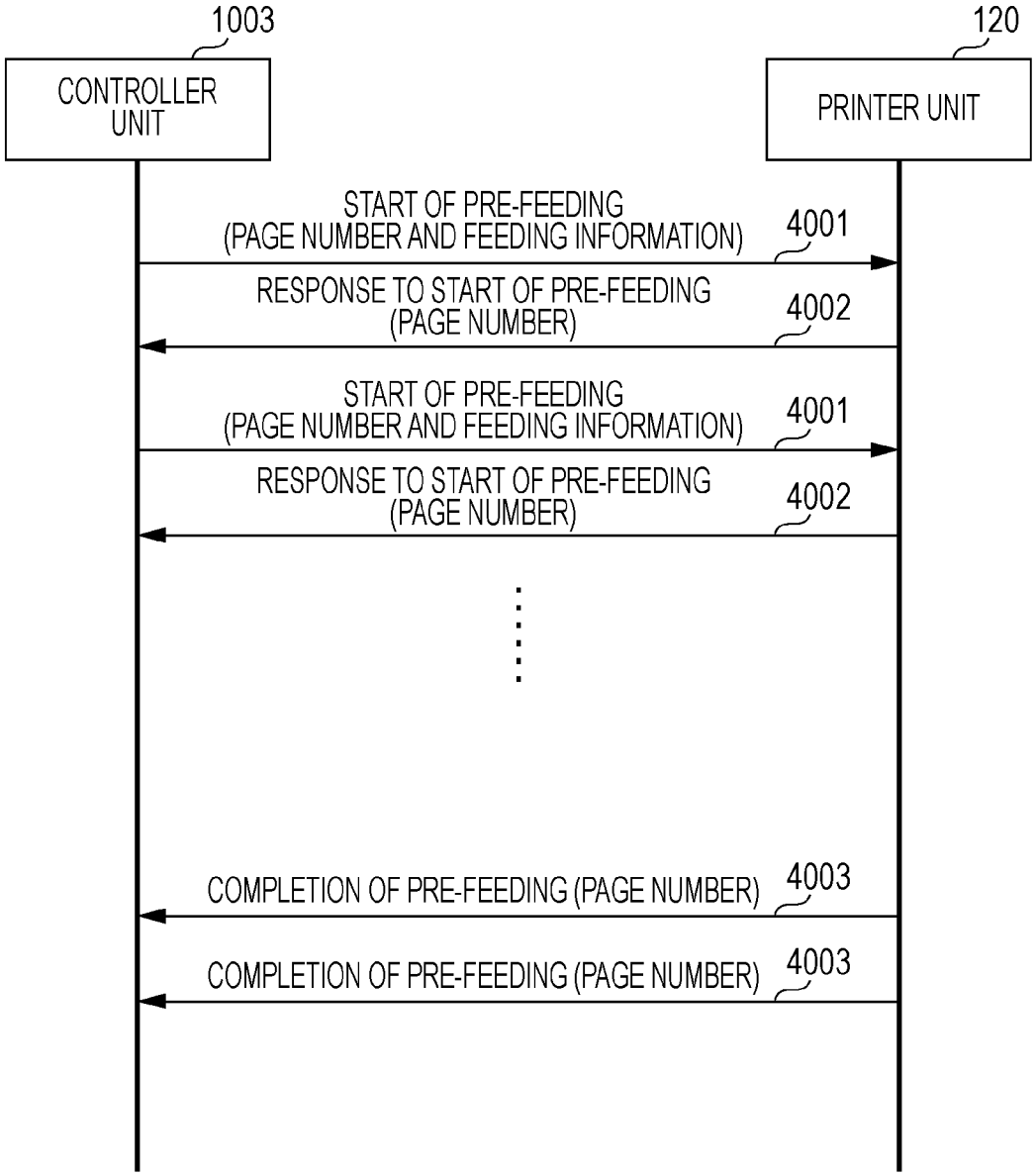
FIG. 4 is a diagram illustrating sequences according to the first embodiment.

First, sequences of the controller unit 1003 and the printer unit 120 at a time of pre-feeding will be described with reference to FIG. 4.

As described above, in a case where a sheet fed from one of the plurality of feeding decks consecutively connected to one another which is located on an upper stream side is to be fed to the image forming section of the print engine 1100, in particular, the sheet is conveyed in a long distance, and accordingly, a long period of time is required for the conveyance of the sheet.

Therefore, before image forming on the sheet is started (or before a process of forming an image to be transferred to the intermediate transfer belt 1009 in a superimposed manner is performed by the individual image forming units 1005 to 1008), the sheet is conveyed to a position near the image forming section of the print engine 1100 in advance. This is referred to as "pre-feeding" hereinafter.

A sequence 4001 represents a request for starting the pre-feeding and is transmitted from the controller unit 1003 to the printer unit 120. Parameters transmitted from the controller unit 1003 to the printer unit 120 in the sequence 4001 correspond to a page number for identification and information on one of the feeding cassettes 1013 and 1014 and the feeding decks 1024 to 1027. Note that, since unique IDs are assigned to the feeding units (a, b, and c) of the feeding decks 1024 to 1027, each of the feeding units (a, b, and c) may be independently specified.

A sequence 4002 is a response message representing reception of the pre-feeding and is transmitted from the printer unit 120 to the controller unit 1003. Simultaneously, the printer unit 120 starts feeding from one of the feeding cassettes 1013 and 1014 and the feeding units (a, b, and c) of the feeding decks 1024 to 1027 which is specified by a print job. When feeding of the sheet is started, the sheet passes a conveying path from one of the feeding cassettes 1013 and 1014 and the feeding trays (a, b, and c) of the feeding decks 1024 to 1027 to the image forming section of the print engine 1100 so as to be conveyed to the preliminary feeding position 1028.

The controller unit 1003 which has received the response message representing the reception of the pre-feeding issues a request for performing the pre-feeding on a next sheet in sequence. Although the sequences of the pre-feeding of two sheets are illustrated in FIG. 4, a number of sheets which may exist in the conveying path are simultaneously subjected to the pre-feeding in parallel in practice. Note that, when the conveying path from one of the feeding cassettes 1013 and 1014 and the feeding trays (a, b, and c) of the feeding decks 1024 to 1027 to the image forming unit of the print engine 1100 is long, the number of sheets which may exist in the conveying path becomes large.

A sequence 4003 represents a notification transmitted from the printer unit 120 to the controller unit 1003 when the pre-feeding is completed and the sheet has reached the preliminary feeding position 1028. Then the controller unit 1003 starts a printing sequence described below with reference to FIG. 5 on the sheets which have been subjected to the pre-feeding.

Figure 5:
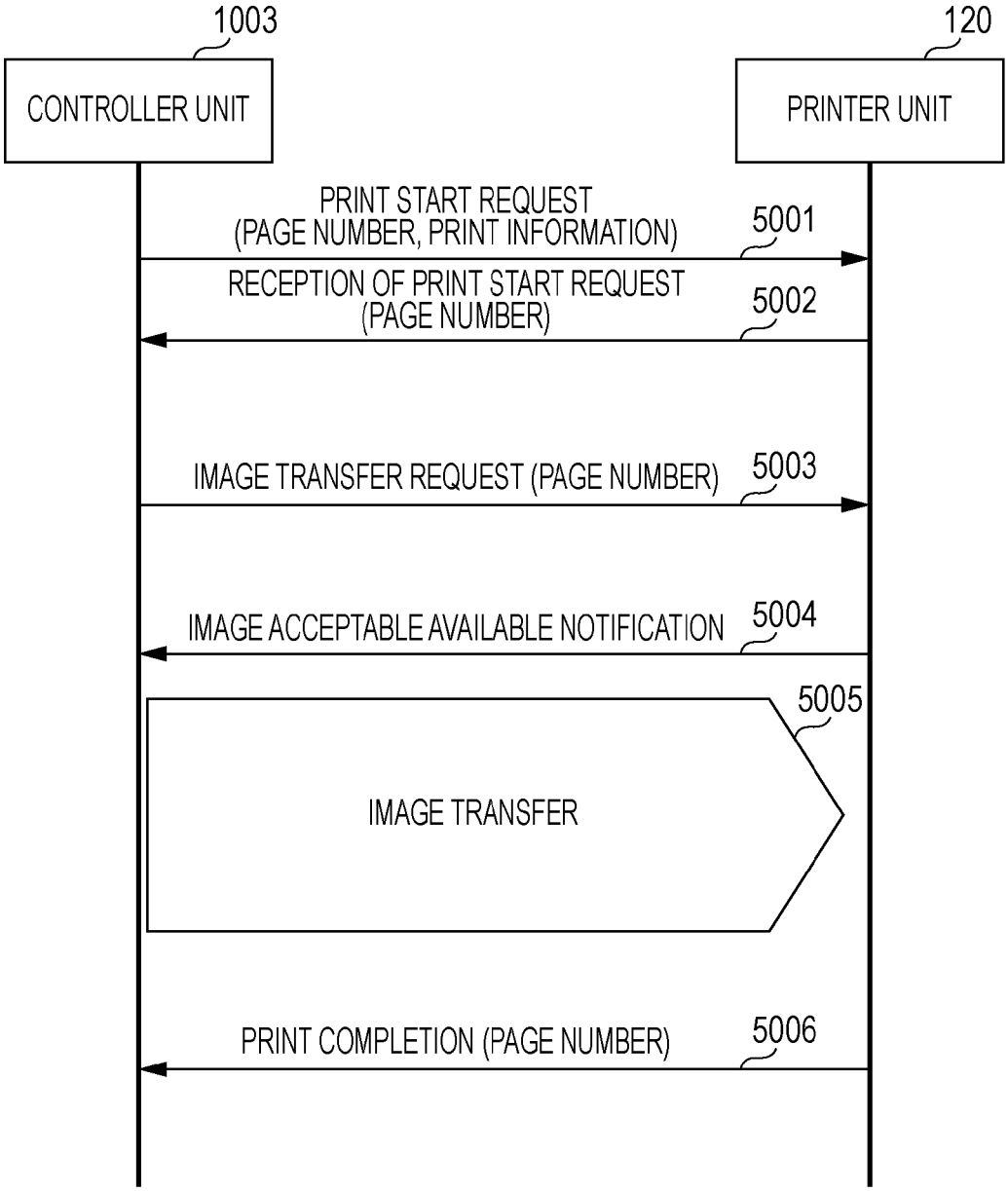
FIG. 5 is a diagram illustrating sequences according to the first embodiment.

Next, sequences of the controller unit 1003 and the printer unit 120 at a time of printing will be described with reference to FIG. 5.

A sequence 5001 represents a request for starting printing and is transmitted from the controller unit 1003 to the printer unit 120.

A sequence 5002 represents a response message to the start of printing and is transmitted from the printer unit 120 to the controller unit 1003 when the printer unit 120 receives the request for starting printing. Simultaneously, the printer unit 120 starts conveyance of a sheet from the preliminary feeding position 1028.

Then the controller unit 1003 develops an image to be formed on the sheet in the RAM 2110 when receiving the response message to the start of printing. A sequence 5003 represents a request for transferring the image which has been developed and is transmitted from the controller unit 1003 to the printer unit 120.

When receiving the request for transferring an image which has been developed, the printer unit 120 conveys the sheet to a registration position 1016 and prepares acceptance of an image.

A sequence 5004 represents a message representing that an image is acceptable and is transmitted from the printer unit 120 to the controller unit 1003 when the conveyed sheet has reached the registration position 1016 and the preparation of acceptance of an image is completed. The message representing that an image is acceptable may be transmitted by a hard signal.

A sequence 5005 represents image transfer from the controller unit 1003 to the printer unit 120. When receiving the message representing an image is acceptable, the controller unit 1003 reads image data from the RAM 2110 and transfers the read image data to the printer unit 120. Then the printer unit 120 forms an image on the sheet on the basis of the received image data.

A sequence 5006 represents a response message representing completion of printing, and is transmitted from the printer unit 120 to the controller unit 1003 when the printed sheet is discharged from the apparatus by the discharge roller 1021 after the printing is completed.

Next, a queue for managing sheets which are under the pre-feeding will be described with reference to FIG. 6. A pre-feeding queue 6000 is stored in the RAM 2110. In the pre-feeding queue 6000, elements 6001 for managing sheets which have been subjected to the pre-feeding in the sequence 4001 (pre-feeding start request) described above with reference to FIG. 4 are managed. Note that, since the request for starting the pre-feeding is issued in order of printing pages, the elements 6001 are stored in the pre-feeding queue 6000 in order of printing pages. Furthermore, elements 6002 for managing sheets which have not been fed are managed in the pre-feeding queue 6000. Note that the request for starting the pre-feeding described with reference to FIG. 4 is issued after the response message to the start of the pre-feeding of a preceding sheet is received. Therefore, the elements 6002 are sheets which have not been fed (that is, sheets in waiting states).

Figure 6:
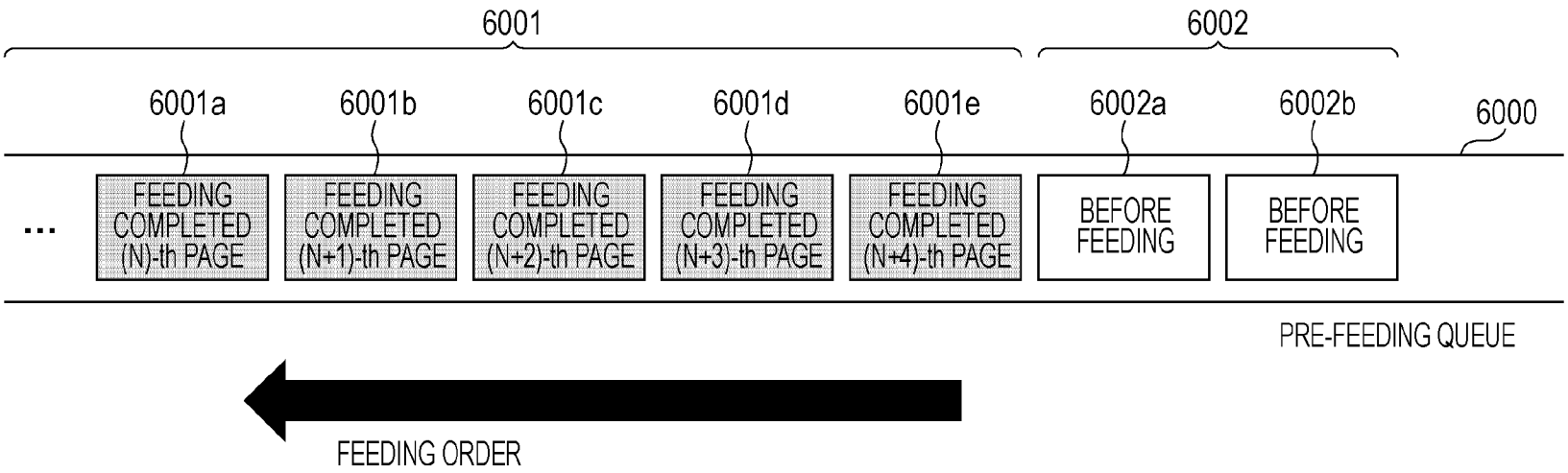
FIG. 6 is a conceptual diagram illustrating a queue according to the first embodiment.

In the example of FIG. 6, in the pre-feeding queue 6000, sheets corresponding to an N-th page to an (N+4)-th page are managed as elements 6001*a* to 6001*e*. Furthermore, sheets of two pages are managed as elements 6002*a* and 6002*b* which have not been fed in the pre-feeding queue 6000.

Subsequently, attribute information (pre-feeding information) on the sheets managed by being associated with the elements 6001 and the elements 6002 stored in the pre-feeding queue 6000 will be described with reference to FIG. 7. Note that the pre-feeding information is stored in the HDD 2130 as a table 7000.

The pre-feeding information includes, for example, a page number 7001, a size 7002 of a sheet which has been subjected to the pre-feeding, and a type 7003 (a basis weight, color, and classification, for example) of the sheet which has been subjected to the pre-feeding.

The pre-feeding information further includes, for example, a sheet holding unit ID 7004 specified by a parameter when a print job is inserted as a source of feeding of a sheet to be used in the print job. Note that the ID 7004 of a feeding cassette (deck) is specified after sheets to be used in the print job are accommodated in the feeding cassettes 1013 and 1014 or the feeding units (a, b, and c) of the feeding decks 1024 to 1027.

Next, a printing queue 8000 will be described with reference to FIG. 8. The printing queue 8000 is stored in the RAM 2110. Elements 8001 corresponding to sheets which have been subjected to the pre-feeding are stored in the printing queue 8000 when the pre-feeding is completed and the controller unit 1003 receives the notification of the sequence 4003 described with reference to FIG. 4. Then the elements 8001 stored in the printing queue 8000 are deleted from the printing queue 8000 when the printing is completed and the controller unit 1003 receives the notification of the sequence 5006 described with reference to FIG. 5.

Figure 8:
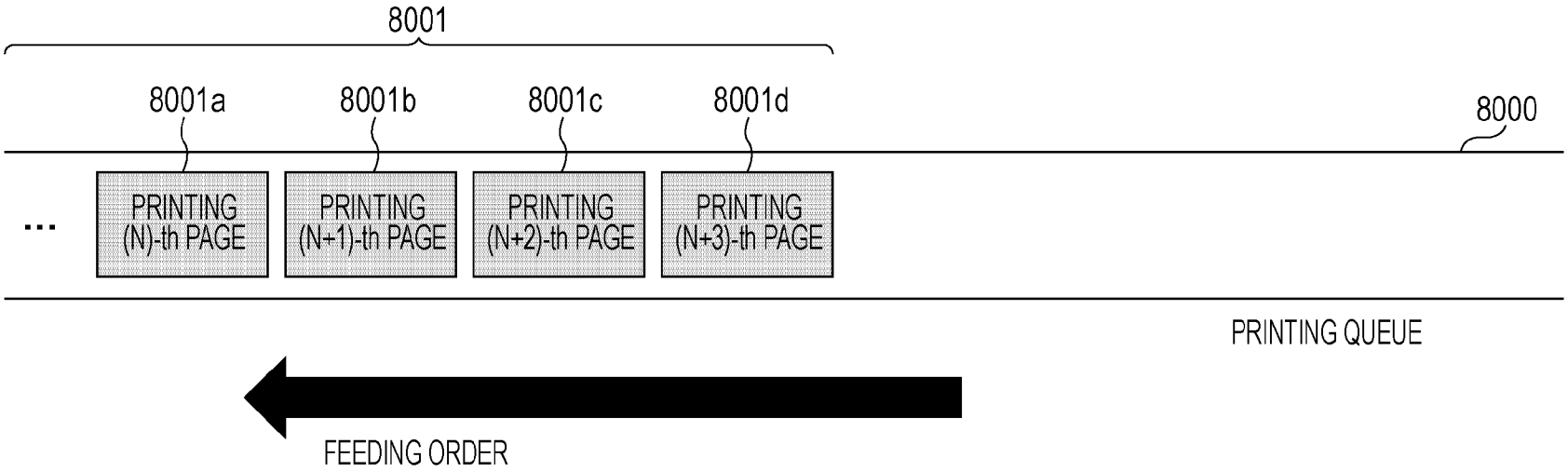
FIG. 8 is a conceptual diagram illustrating a queue according to the first embodiment.

In the example of FIG. 8, in the printing queue 8000, sheets corresponding to an N-th page to an (N+3)-th page are managed as elements 8001 (8001*a*, 8001*b*, 8001*c*, and 8001*d*).

Next, a job list screen 9000 and a job detail screen 9100 displayed in the display unit 161 of the operation unit 160 will be described with reference to FIGS. 9(A) and 9(B).

The job list screen 9000 is used to check a list of print jobs which are instructed to be executed. On the other hand, the job detail screen 9100 is used to check detailed information (a reception time, a job type, a file name, a user name, the number of pages, and the number of copies, for example) on print data of the jobs which are instructed to be executed.

When an execution of the sample printing is to be instructed, first, the user selects one of the print jobs to be subjected to the sample printing in the job list screen 9000. Note that the sample printing means printing of a page being printed (or an arbitrary page specified by the user) on a sheet which is different from a sheet for the main printing so that the user checks quality (layout and color, for example) of a printed matter.

Figure 9A:
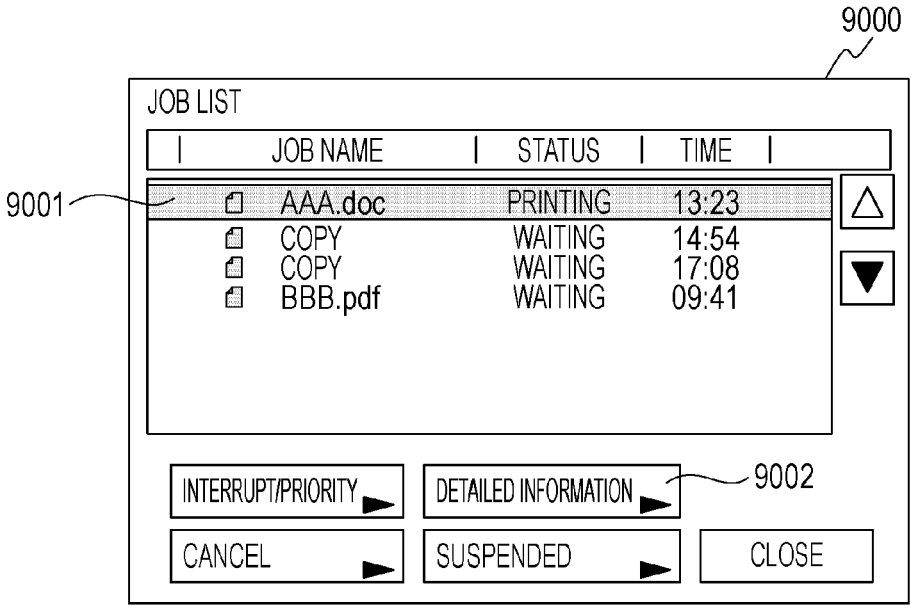
FIGS. 9A and 9B are diagrams illustrating configurations of screens according to the first embodiment.
Figure 10A:
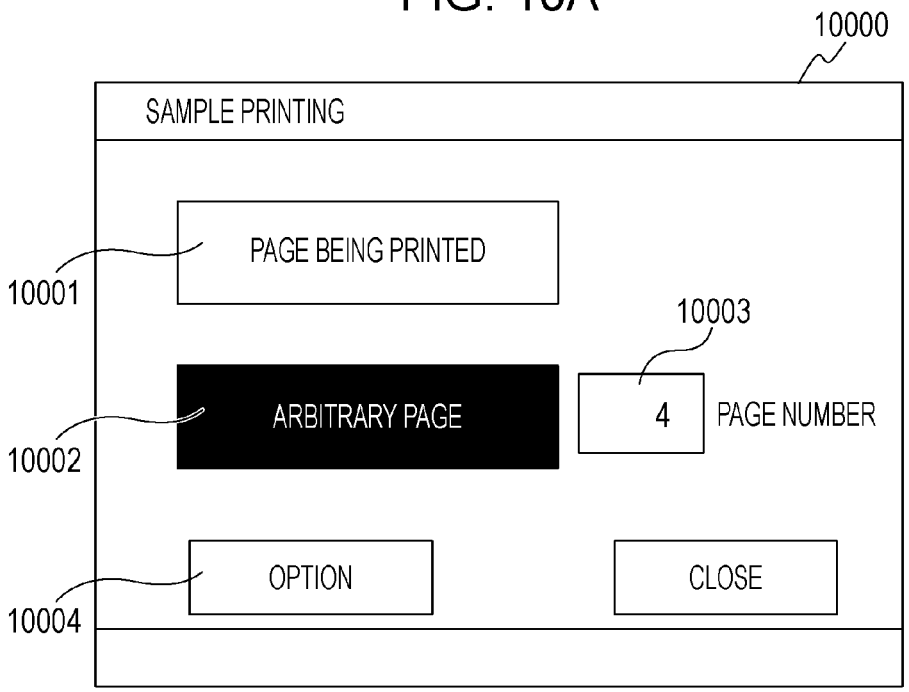
FIGS. 10A and 10B are diagrams illustrating configurations of screens according to the first embodiment.

In the example of FIG. 9A, a state 9001 in which a print job "AAA.doc" being printed is selected is illustrated. The user presses a detailed information button 9002 in the job list screen 9000 in the state 9001 in which the print job is selected. When the detailed information button 9002 is pressed, the job detail screen 9100 is displayed. Thereafter, the user presses a sample printing button 9101 in the job detail screen 9100. When the sample printing button 9101 is pressed, a setting screen 10000 (FIG. 10A) for the sample printing of the selected print job is displayed in the display unit 161.

The user may select a page being printed or an arbitrary page in the setting screen 10000 as a sample printing method.

Note that the page being printed corresponds to one of the elements 8001 which is located in a leading portion of the printing queue 8000. The CPU 2100 obtains a page number from the leading element 8001, reads corresponding image data from the HDD 2130, and develops the image data in the RAM 2110. When the development is completed, the CPU 2100 inserts an element for the sample printing in the pre-feeding queue 6000 by a series of processes described later with reference to FIG. 12.

When the sample printing of the page being printed is to be performed, the user simply presses a button 10001 in the setting screen 10000. The sample printing of the page being printed means an operation of performing printing by copying image data corresponding to the page being printed. In a case where the selected print job in the state 9001 is temporarily stopped or is in a print waiting state, the button 10001 is grayed out so as not be pressed by the user. Alternatively, in a case where the selected print job in the state 9001 is temporarily stopped or is in a print waiting state, pressing of the button 10001 may be ignored.

When the sample printing of an arbitrary one of a plurality of pages of image data is to be performed, the user simply presses a button 10002 in the setting screen 10000. The sample printing of the arbitrary page means an operation of performing printing by copying image data corresponding to an arbitrarily-selected page. A number 10003 of a page to be subjected to the sample printing may be arbitrarily input by the user using the numeric keypad included in the hard key group 164. Note that, in a case where a page number has not been input or in a case where a page out of range is input, a first page is selected as the page number 10003 by default.

When the sample printing is performed on an arbitrary page, the CPU 2100 reads image data corresponding to the arbitrarily-selected page from the HDD 2130 and develops the image data in the RAM 2110. When the development is completed, the CPU 2100 inserts an element for the sample printing in the pre-feeding queue 6000 by the series of processes described later with reference to FIG. 12.

Note that when a button 10004 in the setting screen 10000 is pressed by the user, a selection screen 10100 used to select an option of the sample printing is displayed in the display unit 161.

When a check box 10101 is selected by the user in the selection screen 10100, the sample printing is executed without taking a size and a type of a sheet into consideration. On the other hand, when a check box 10102 is selected in the selection screen 10100, the sample printing is executed without taking the feeding cassettes 1013 and 1014 and the feeding decks 1024 to 1027 (a, b, and c) used in the sample printing into consideration.

In a case where the sample printing is performed for recognizing color tones of a printed matter, for example, if a different type of sheet is used for printing, the color tones may not be appropriately recognized. In this case, the user unchecks the check box 10101 in order to more reliably recognize the color tones of the printed matter by the sample printing.

On the other hand, in a case where the sample printing is performed for checking layout of the printed matter, for example, even if a different type of sheet is used for printing, the layout may be recognized. In this case, the user checks the check box 10101 in order to perform the sample printing at higher speed.

For example, special sheets, such as pre-printing sheets, are stored in a specific sheet holding unit (the feeding cassette 1013, the feeding deck 1024, or the like) in advance. Therefore, in a case where the sample printing is performed using a pre-printing sheet, the specific sheet holding unit which accommodates the pre-printing sheets is taken into consideration as a sheet feeding source, and accordingly, the user unchecks the check box 10102.

On the other hand, the sample printing is performed without using the special sheets, such as the pre-printing sheets, the sample printing may be performed on a sheet supplied from any one of the sheet holding units (such as the feeding cassette 1013 and the feeding deck 1024). In this case, the user checks the check box 10102 in order to perform the sample printing at higher speed.

Since the check box 10101 and the check box 10102 are mutually exclusive, the user may select one of the check boxes 10101 and 10102.

Figure 11:
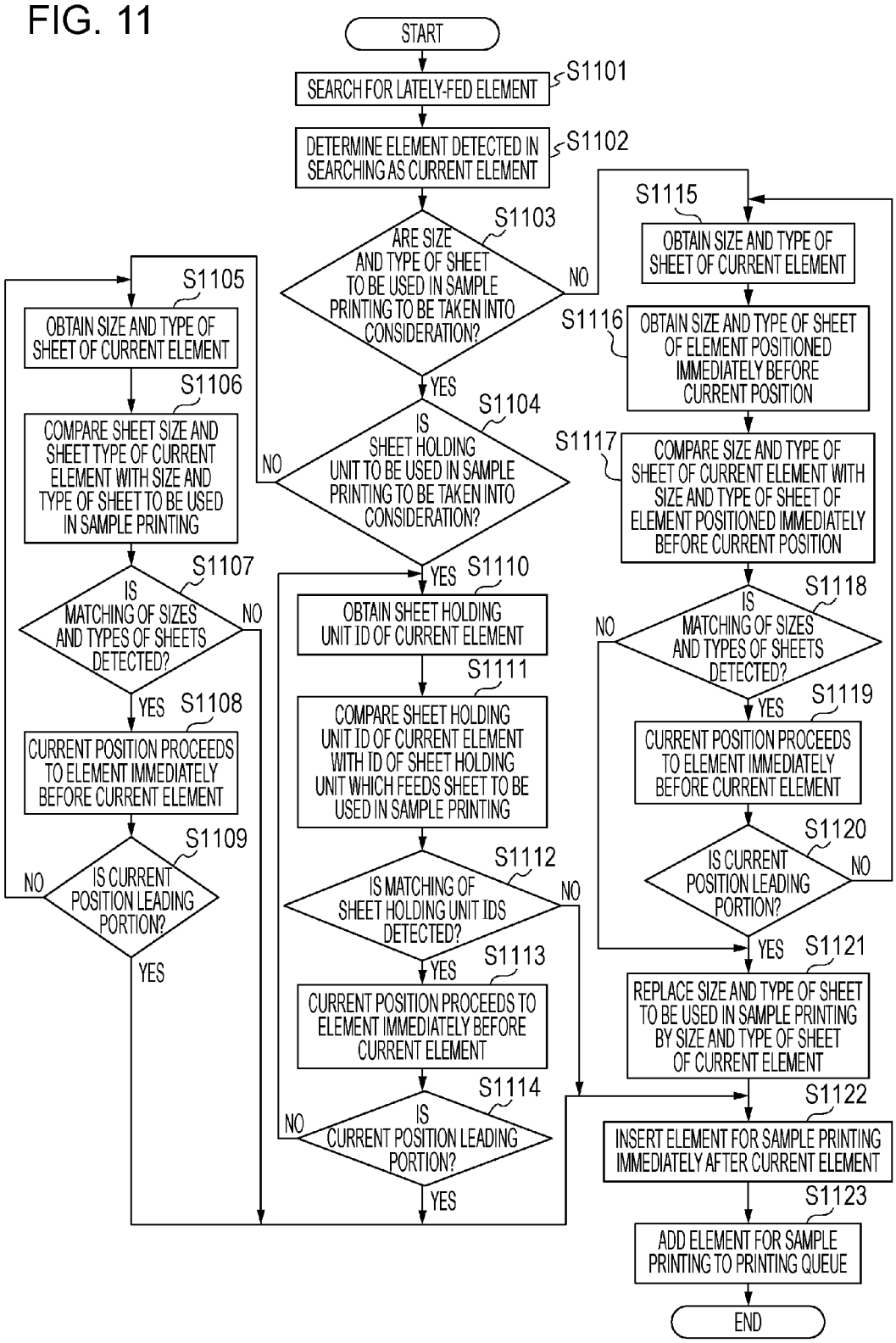
FIG. 11 is a flowchart illustrating control according to the first embodiment.

Next, a series of processes of inserting an element for the sample printing into the pre-feeding queue 6000 and executing the sample printing in the printing apparatus 1000 will be described with reference to a flowchart illustrated in FIG. 11. The series of processes illustrated in FIG. 11 is performed when the CPU 2100 of the controller unit 1003 executes the control program which is read from the ROM 2120 or the HDD 2130 and developed in the RAM 2110.

Figure 9B:
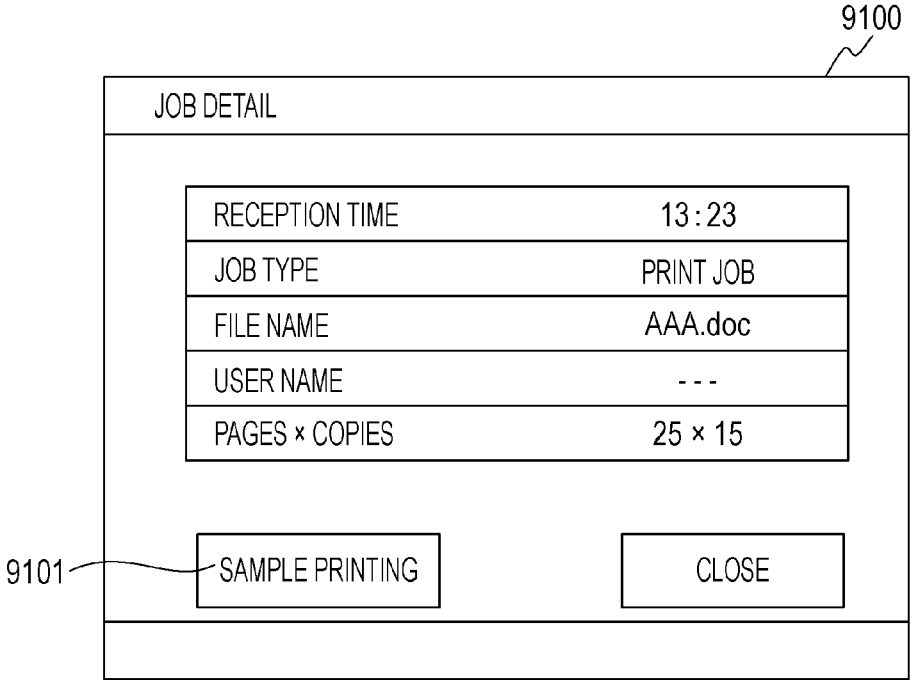

This process is started, for example, in a state in which an arbitrary print job is selected in the job list screen 9000 illustrated in FIG. 9A and an instruction for performing the sample printing is issued using the job detail screen 9100 illustrated in FIG. 9B. Furthermore, this process is started in a state in which attribute information on a sheet to be used for the sample printing (or attribute information on a sheet to be used in a print job in a case where a size and a type of the sheet is to be taken into consideration in the sample printing) is obtained. Specifically, the process is stated in a state in which a size and a type of the sheet to be used in the sample printing and an ID and the like of a sheet holding unit which feeds the sheet to be used in the sample printing are obtained in accordance with a page of print data to be subjected to the sample printing determined through the setting screen 10000.

In step S1101, the CPU 2100 traces back the pre-feeding queue 6000 of FIG. 6 from the tail end so as to search for an element which has been lastly fed and proceeds to step S1102. In the example of FIG. 6, the element 6001*e* corresponds to the lastly fed element.

In step S1102, the CPU 2100 determines the element found in the searching in step S1101 as a current element and the process proceeds to step S1103.

Figure 10B:
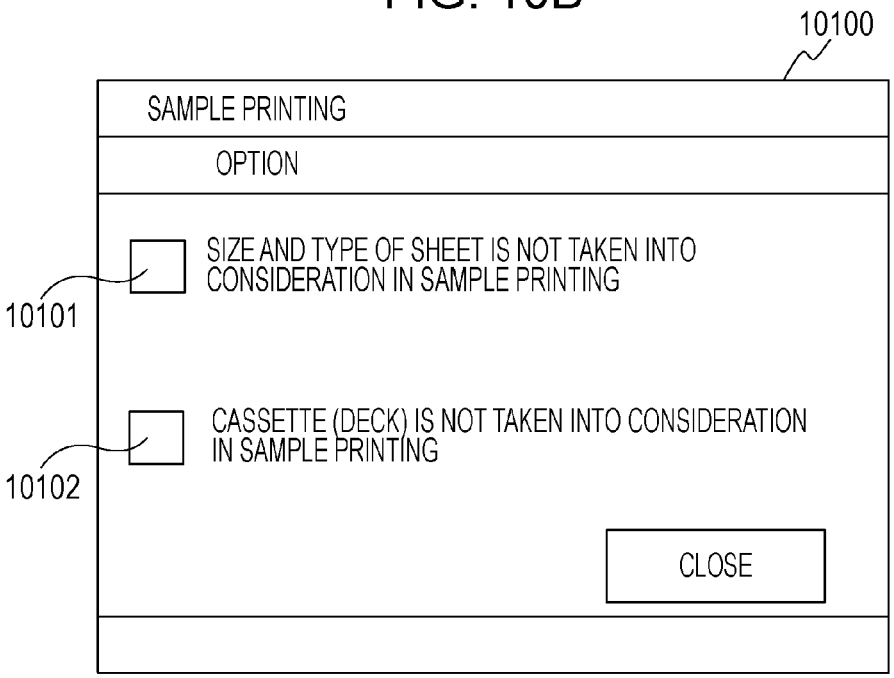

In step S1103, the CPU 2100 determines whether a size and a type of a sheet to be used in the sample printing are to be taken into consideration. When the check box 10101 is selected in the selection screen 10100 of FIG. 10B, the CPU 2100 determines that the size and the type of the sheet to be used in the sample printing are not taken into consideration (that is, NO). On the other hand, when the check box 10101 is not selected in the selection screen 10100, the CPU 2100 determines that the size and the type of the sheet to be used in the sample printing are taken into consideration (that is, YES). As a result of the determination in step S1103, when the CPU 2100 made an affirmative determination, the process proceeds to step S1104. On the other hand, when the CPU 2100 made a negative determination, the process proceeds to step S1115.

In step S1104, the CPU 2100 determines whether the sheet holding unit to be used in the sample printing (one of the feeding cassettes 1013 and 1014 and the feeding units (a, b, and c) of the feeding decks 1024 to 1027) is to be taken into consideration. When the check box 10102 is selected in the selection screen 10100, the CPU 2100 determines that the sheet holding unit to be used in the sample printing is not taken into consideration (that is, NO). On the other hand, when the check box 10102 is not selected in the selection screen 10100, the CPU 2100 determines that the sheet holding unit to be used in the sample printing is taken into consideration (that is, YES). As a result of the determination in step S1104, when the CPU 2100 made an affirmative determination, the process proceeds to step S1110. On the other hand, when the CPU 2100 made a negative determination, the process proceeds to step S1105.

Figure 7:
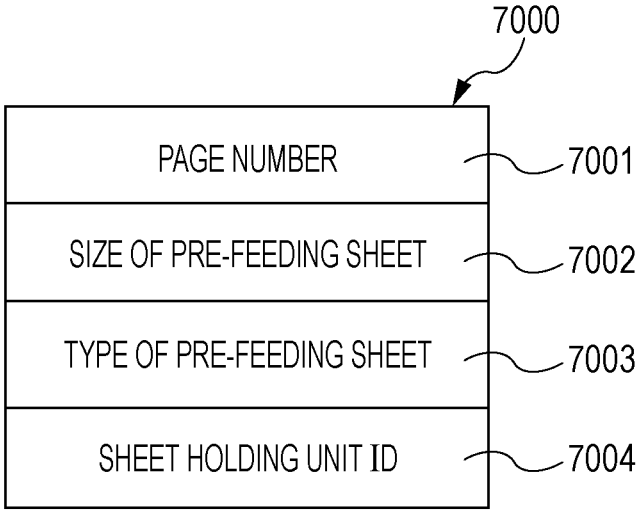
FIG. 7 is an example of a table according to the first embodiment.

In step S1105, the CPU 2100 refers to the table 7000 of FIG. 7 stored in the HDD 2130, obtains a size 7002 and a type 7003 of a sheet of the current element as pre-feeding information, and proceeds to step S1106.

In step S1106, the CPU 2100 compares the size 7002 and the type 7003 of the sheet obtained in step S1105 with a size and a type of the sheet to be used in the sample printing, and proceeds to step S1107.

In step S1107, the CPU 2100 determines whether the sizes and the types of the sheets match as a result of the comparison in step S1106. As a result of the determination in step S1107, when the CPU 2100 determines that the sizes and the types of the sheets match (that is, YES), the process proceeds to step S1108. On the other hand, when the CPU 2100 determines that sizes or the types of the sheets do not match or both of the sizes and the types of the sheets do not match (that is, NO), the process proceeds to step S1122.

In step S1108, the CPU 2100 sets a current position to an element immediately before the current element (that is, determines an element in a position immediately before a current position as the current element) and the process proceeds to step S1109. In the example of FIG. 6, in a case where the element 6001*e* is the current element in the current position, the element 6001*d* which is in a position immediately before the current position is determined as the current element. In step S1109, the CPU 2100 determines whether the current position corresponds to a leading portion of the pre-feeding queue 6000. As a result of the determination in step S1109, when the CPU 2100 determines that the current position is the leading portion (that is, YES), the CPU 2100 inserts NULL into the current position and the process proceeds to step S1122.

In step S1122, the CPU 2100 inserts an element for the sample printing in a position immediately after the current element (that is, an element for the main printing is replaced by the element for the sample printing). Note that, when the current element is NULL, the element for the sample printing is inserted into the leading portion of the pre-feeding queue 6000.

As a result of the determination in step S1109, when the CPU 2100 made a negative determination, the process returns to step S1105 and performs the process from step S1105 onwards again.

Next, a case where the process proceeds from step S1104 to step S1110 will be described.

In step S1110, the CPU 2100 refer to the table 7000 of FIG. 7 stored in the HDD 2130, obtains a sheet holding unit ID 7004 of the current element as pre-feeding information, and proceeds to step S1111.

In step S1111, the CPU 2100 compares the sheet holding unit ID 7004 of the current element obtained in step S1110 with an ID of a sheet holding unit which feeds the sheet to be used in the sample printing, and proceeds to step S1112.

In step S1112, the CPU 2100 determines whether the sheet holding unit IDs match each other as a result of the comparison in step S1111. As a result of the determination in step S1112, when the CPU 2100 determines that the sheet holding unit IDs match each other (that is, YES), the process proceeds to step S1113. On the other hand, when the CPU 2100 made a negative determination, the process proceeds to step S1122.

In step S1113, the CPU 2100 sets a current position to an element immediately before the current element (that is, determines an element in a position immediately before the current position as the current element) and the process proceeds to step S1114.

In step S1114, the CPU 2100 determines whether the current position corresponds to the leading portion of the pre-feeding queue 6000. As a result of the determination in step S1114, when the CPU 2100 determines that the current position is the leading portion (that is, YES), the CPU 2100 inserts NULL into the current position and the process proceeds to step S1122. In step S1122, the CPU 2100 inserts an element for the sample printing in a position immediately after the current element (that is, an element for the main printing is replaced by the element for the sample printing). Note that, when the current element is NULL, the element for the sample printing is inserted into the leading portion of the pre-feeding queue 6000.

On the other hand, as a result of the determination in step S1114, when the CPU 2100 made a negative determination, the process returns to step S1110 and performs the process from step S1110 onwards again.

Next, a case where the process proceeds from step S1103 to step S1115 will be described.

In step S1115, the CPU 2100 refer to the table 7000 stored in the HDD 2130, obtains the size 7002 and the type 7003 of the sheet of the current element as pre-feeding information, and proceeds to step S1116.

In step S1116, the CPU 2100 refers to the table 7000 stored in the HDD 2130, obtains a size 7002 and a type 7003 of a sheet of an element positioned immediately before the current position, and proceeds to step S1117.

In step S1117, the CPU 2100 compares the size 7002 and the type 7003 of the sheet obtained in step S1115 with the size 7002 and the type 7003 of the sheet obtained in step S1116, and proceeds to step S1118.

In step S1118, as a result of the comparison in step S1117, the CPU 2100 determines whether the sizes 7002 and the types 7003 of the sheets match each other. As a result of the determination in step S1118, when the CPU 2100 determines that the sizes 7002 and the types 7003 of the sheets match each other (that is, YES), the process proceeds to step S1119. On the other hand, when the CPU 2100 determines that the sizes 7002 or the types 7003 of the sheets do not match each other or both of the sizes 7002 and the types 7003 of the sheets do not match (that is, NO), the process proceeds to step S1121.

In step S1119, the CPU 2100 sets a current position to an element immediately before the current position (that is, determines an element in a position immediately before the current position as the current element) and proceeds to step S1120.

In step S1120, the CPU 2100 determines whether the current position corresponds to the leading portion of the pre-feeding queue 6000. As a result of the determination in step S1120, when the CPU 2100 determines that the current position is the leading portion (that is, YES), the CPU 2100 inserts NULL into the current position and proceeds to step S1121. On the other hand, when the CPU 2100 made a negative determination, the process returns to step S1115 and the process from step S1115 onwards is performed again.

In step S1121, the CPU 2100 replaces the size and the type of the sheet to be used in the sample printing by the size 7002 and the type 7003 of the sheet of the current element, and proceeds to step S1122.

In a case where the size and the type of the sheet to be used in the sample printing are represented by "A4 coated paper" and the size 7002 and the type 7003 of the sheet of the current element are represented by "A4 regular paper", the sample printing is performed on the sheet of "A4 regular paper". Consequently, shortage of the number of sheets of "A4 regular paper" to be subjected to the main printing occurs, and accordingly, an element for the main printing is newly inserted in an end portion of the pre-feeding queue 6000.

In step S1122, the CPU 2100 inserts an element for the sample printing in a position immediately after the current element (that is, the element for the main printing is replaced by the element for the sample printing). Note that, when the current element is NULL, the element for the sample printing is inserted into the leading portion of the pre-feeding queue 6000.

After the process in step S1122, the process proceeds to step S1123.

In step S1123, the CPU 2100 inserts an element for the sample printing in the printing queue 8000 of FIG. 8 when the element for the sample printing inserted in step S1122 reaches the leading portion of the pre-feeding queue 6000. Then the element (8001) for the sample printing stored in the printing queue 8000 is to be subjected to the sample printing as described hereinabove with reference to FIG. 5.

After the process in step S1123, the series of processes in FIG. 11 is terminated. The series of processes of inserting an element for the sample printing into the pre-feeding queue 6000 and thereafter executing the sample printing in the printing apparatus 1000 has been described in detail hereinabove.

Figure 12:
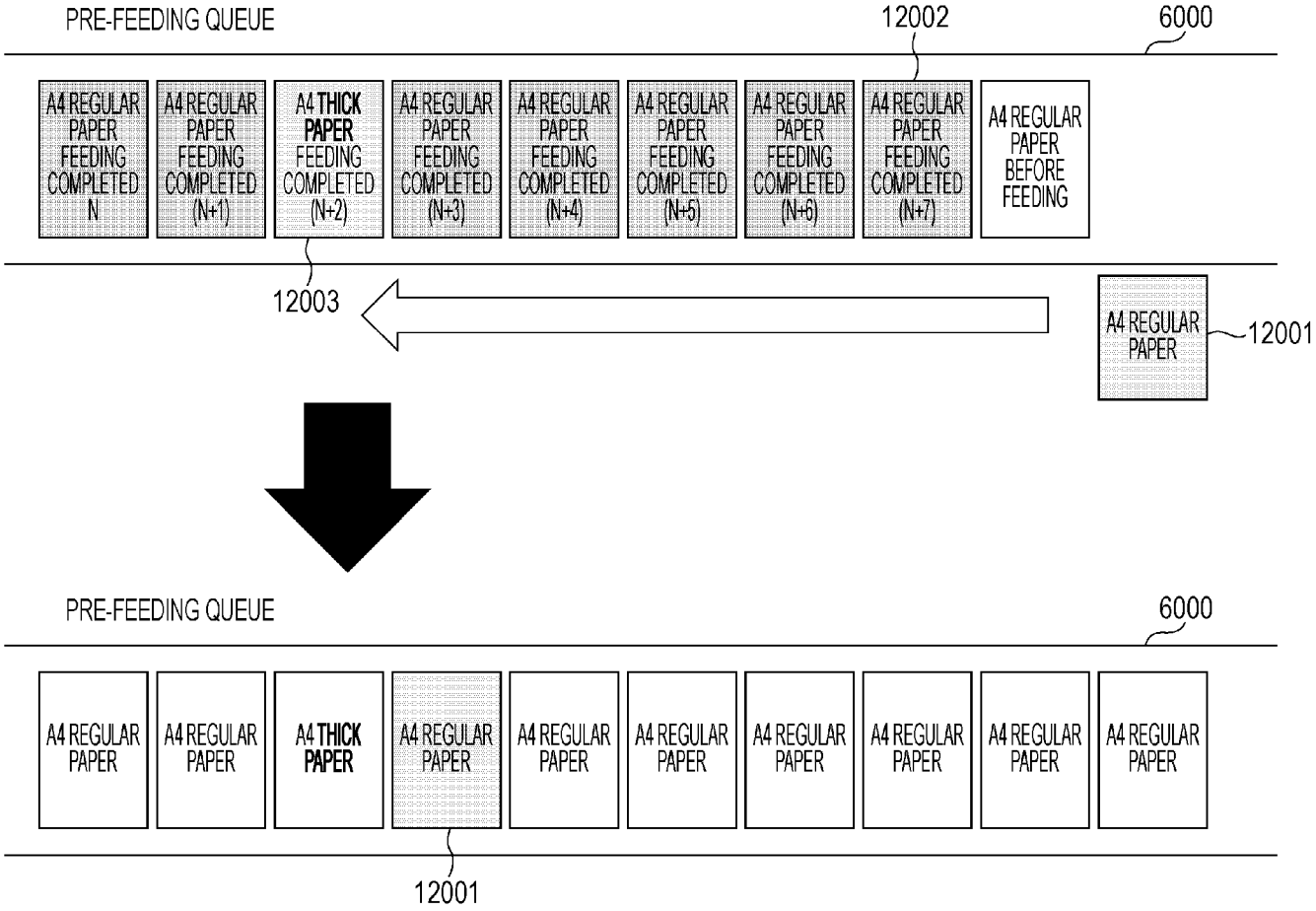
FIG. 12 is a conceptual diagram illustrating a queue according to the first embodiment.

Next, a case (an example) where an element 12001 for the sample printing (a sheet size is "A4" and a sheet type is "regular paper", for example) is inserted into the pre-feeding queue 6000 will be described with reference to FIG. 12. First, by the searching in step S1101 described with reference to FIG. 11, an element 12002 is determined as a current element (S1102). In a case where a sheet holding unit to be used in the sample printing is not taken into consideration although a size and a type of a sheet to be used in the sample printing are taken into consideration (that is, YES in step S1103 and NO in step S1104), the process from step S1105 to step S1109 is repeatedly performed. By this, elements are successively traced backward from a current position of the element 12002. In a position of an element 12003, a difference of sheet types, that is, a difference between "regular paper" and "thick paper", is detected (NO in step S1107), and therefore, the element 12001 for the sample printing is inserted in a position immediately after the element 12003 (S1122). Elements (the elements 12002 for the main printing and the element 12001 for the sample printing) which have reached the leading portion of the pre-feeding queue 6000 are successively inserted into the printing queue 8000 of FIG. 8 and subjected to printing.

In this way, since the searching is started backward from the last one of elements which have been fed and the elements are successively traced backward from the current position of the element 12002, even when the element 12001 for the sample printing is inserted, the sizes and the types of the sheets for the main printing are not unintentionally changed. In a case where sizes and types of sheets of all the elements stored in the pre-feeding queue 6000 are the same, the searching may be started from the leading portion of the elements which have been fed and the elements may be successively traced to the end portion from the current position of the element 12002. This is because, since the sizes and the types of the sheets of all the elements stored in the pre-feeding queue 6000 are the same as one another, even when the element 12001 for the sample printing is inserted, the sizes and the types of the sheets for the main printing are not changed.

As described above, the CPU 2100 performs control such that the sample printing is performed on a specific one of the plurality of sheets fed from the sheet holding units for executing the main printing when receiving an instruction for executing the sample printing issued by the user.

Specifically, the printing apparatus 1000 according to the first embodiment to which the present invention is applied may execute the sample printing on a sheet which has been fed for the main printing when receiving an instruction for executing the sample printing issued by the user. Therefore, when compared with a general method in which a sheet for sample printing is fed from a sheet holding unit after an instruction for executing the sample printing is received from a user, the user may recognize a result of the sample printing performed on the sheet earlier.

The present invention is not limited to the foregoing embodiment, various modifications (including organic combinations of embodiments) based on the scope of the present invention may be made, and the modifications are not excepted from the range of the present invention.

Although the CPU 2100 of the controller unit 1003 included in the printing apparatus 1000 is a main component for the various control operations described above, for example, in this embodiment, the present invention is not limited to this. Some or all of the various control operations may be executed by a print control apparatus, such as an external controller included in a case different from the printing apparatus 1000.

Furthermore, although the case where the four feeding decks 1024 to 1027 are consecutively connected to the printing apparatus 1000 has been described in this embodiment, the present invention is not limited to this. Even in a case where none of the feeding decks 1024 to 1027 is connected to the printing apparatus 1000, if the feeding cassettes 1013 and 1014 are included in the printing apparatus 1000, the first embodiment of the present invention may be similarly described.

Although the various examples and the embodiment of the present invention have been described hereinabove, the scope and the range of the present invention are not limited to the specific descriptions in this specification.

Other Embodiment

The present invention may be realized by a process of supplying a program which realizes at least one of the functions of the foregoing embodiment to a system or an apparatus through a network or a storage medium and reading and executing the program using at least one processor included in a computer of the system or the apparatus. Furthermore, the present invention may be realized by a circuit (an ASIC, for example) which realizes at least one of the functions.

According to the present invention, the user may check a result of sample printing performed on a sheet earlier than a case where a general apparatus and a general method are used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2014/080760, filed Nov. 20, 2014, which is hereby incorporated by reference herein in its entirety.

The invention claimed is:

1. A printing apparatus comprising:

a printing unit configured to perform a print job for printing pages based on print data;

a receiving unit configure to receive, from a user, an instruction for printing a selected page of the print job additionally while the print job are performed; and a print controlling unit configured to control the printing unit to print the pages, wherein the print controlling unit is configured to control, according to the reception of the instruction, the printing unit to print the selected page and the pages other than a last page among the pages on conveyed sheets, the last page being printed on a sheet conveyed next to the conveyed sheets.

2. The printing apparatus according to claim 1, wherein the print controlling unit control, according to the reception of the instruction, the printing unit to print the selected page on a first sheet among the conveyed sheets and the pages other than the last page on a rest sheets among the conveyed sheets.

3. The printing apparatus according to claim 1, wherein the selected page corresponds to a timing of the reception of the instruction.

4. The printing apparatus according to claim 1, wherein the selected page is selected by the user from among a plurality of pages of the print job.

5. The printing apparatus according to claim 4, wherein the printed selected page is discharged to a tray different from a tray to which the printed pages are discharged.

6. The printing apparatus according to claim 1, wherein the printed selected page is used for checking a result of printing of the selected page.

7. The printing apparatus according to claim 1, wherein the conveyed sheets are conveyed along a conveying path which includes the conveyed sheets.

8. The printing apparatus according to claim 1, wherein the conveyed sheets are sheets fed for the pages from at least one sheet holding unit before the receiving unit receives the instruction.

9. The printing apparatus according to claim 1, wherein the print controlling unit is configured to control the print unit to print the pages on the conveyed sheets and not to print the selected page if the receiving unit does not received the instruction.

10. The printing apparatus according to claim 1, wherein the print controlling unit is configured to control the print unit to print the pages on the conveyed sheets and the selected page on a sheet conveyed next to the conveyed sheets if the receiving unit received the instruction and a type of a last sheet of the conveyed sheets is different from a type of a sheet for the selected page.

11. The printing apparatus according to claim 1, wherein the print controlling unit is configured to control the print unit to print the pages on the conveyed sheets and the selected page on a sheet conveyed next to the conveyed sheets if the receiving unit received the instruction and a sheet holding unit from which a last sheet of the conveyed sheets is fed is different from a sheet holding unit which holds a sheet for the selected page.

12. A printing system comprising:

a printing unit configured to perform a print job for printing pages based on print data;

a receiving unit configure to receive, from a user, an instruction for printing a selected page of the print job additionally while the print job are performed; and a print controlling unit configured to control the printing unit to print the pages, wherein the print controlling unit is configured to control, according to the reception of the instruction, the printing unit to print the selected page and the pages other than a last page among the pages on conveyed sheets, the conveyed sheets being fed for the pages from at least one sheet holding unit before the receiving unit receives the instruction, the last page being printed on a sheet fed next to the fed sheets.

13. A printing method comprising:

receiving print data to perform a print job for printing pages based on the print data;

feeding sheets for the pages from at least one sheet holding unit;

after the feeding of the sheets, receiving from a user, an instruction for printing a selected page of the print job additionally while the print job are performed; and controlling printing the pages, wherein the controlling controls, according to the reception of the instruction, printing the selected page and the pages other than a last page among the pages on the fed sheets, the last page being printed on a sheet fed next to the fed sheets.

* * * * *